US005984670A

United States Patent [19]

McMillan et al.

[11] Patent Number: 5,984,670

[45] Date of Patent: Nov. 16, 1999

[54] BURNER

[75] Inventors: Robin McMillan, Bardney, United Kingdom; Ennio Pasqualotto, Meilen, Switzerland

[73] Assignee: Asea Brown Boveri AG, Baden, Switzerland

[21] Appl. No.: 08/995,933

[22] Filed: Dec. 22, 1997

[30] Foreign Application Priority Data

Dec. 21, 1996 [DE] Germany ..... 196 54 008

[51] Int. Cl.[6] ..... B05B 7/10; F23M 3/00; F23D 14/46

[52] U.S. Cl. ..... 431/350; 431/9; 431/182; 431/351; 239/403; 239/405; 239/472

[58] Field of Search ..... 431/9, 10, 116, 431/173, 182, 183, 187, 284, 285, 350, 351, 352; 239/403, 405, 463, 472, 475; 60/737, 748

[56] References Cited

U.S. PATENT DOCUMENTS

| | | | |
|---|---|---|---|
| 1,336,261 | 4/1920 | Scott | 431/350 |
| 1,636,616 | 7/1927 | Scheuermann | 431/350 |
| 4,624,631 | 11/1986 | Kobayashi et al. | 431/350 |
| 4,781,030 | 11/1988 | Hellat et al. | 60/737 |
| 5,049,066 | 9/1991 | Kaiya et al. | 431/352 |
| 5,540,213 | 7/1996 | Shell et al. | 431/350 |
| 5,584,182 | 12/1996 | Althus et al. | 60/737 |
| 5,647,538 | 7/1997 | Richardson | 239/405 |
| 5,664,943 | 9/1997 | Joos et al. | 431/351 |

FOREIGN PATENT DOCUMENTS

| | | |
|---|---|---|
| 0321809B1 | 6/1989 | European Pat. Off. . |
| 4119278C2 | 12/1992 | Germany . |

*Primary Examiner*—Ira S. Lazarus
*Assistant Examiner*—David Lee
*Attorney, Agent, or Firm*—Burns, Doane, Swecker & Mathis, L.L.P.

[57] ABSTRACT

A burner for liquid and/or gaseous fuels (A, B, C) for a premixing combustion system in graduated load operation of a combustion chamber includes at least one inner partial body (2) that extends in the flow direction; at least one outer partial body (4) which extends conically opposite to the inner partial body (2); and at least one other surrounding pipe (8). The inner and outer partial bodies form a central flow structure, whereby the two are supplied with the flow in effective connection with each other with combustion air (13, 14, 15). The main part of this combustion air (13) then flows through the two partial bodies through air inlet slits (11, 12) and forms one rotational flow in each of the adjoining flow chamber (5, 7).

10 Claims, 2 Drawing Sheets

FIG. 2
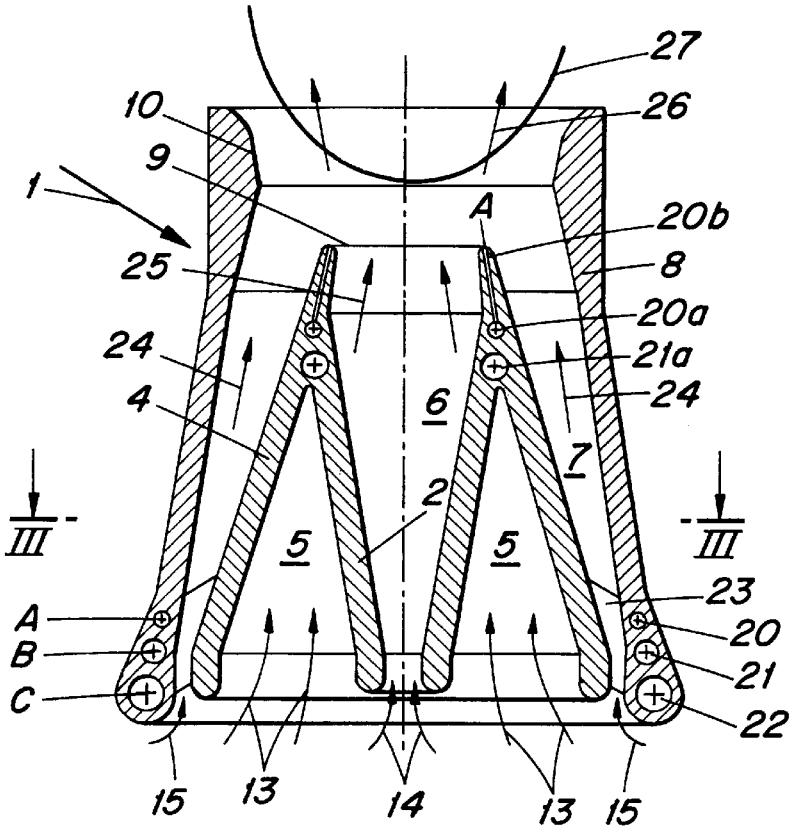
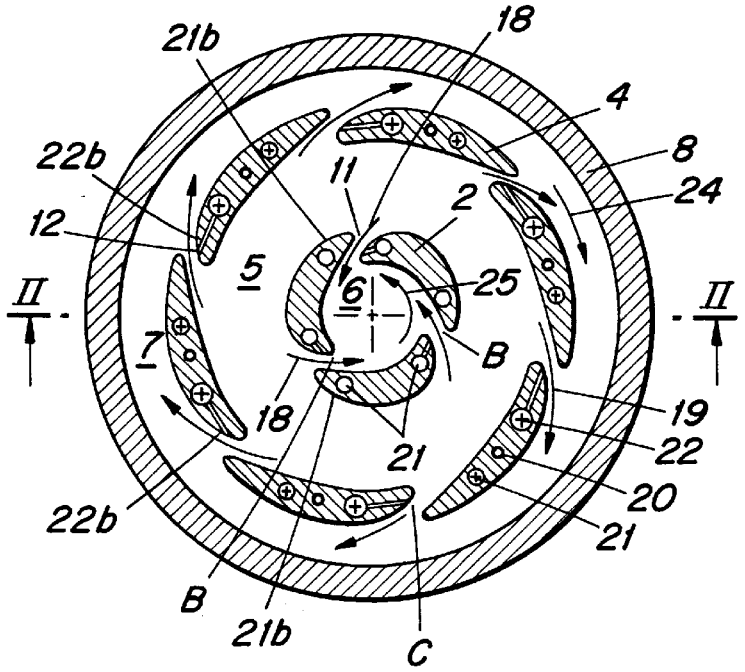
FIG. 3

BURNER

BACKGROUND OF THE INVENTION

1. Field of the Invention

The present invention relates to a burner for premixing liquid and gaseous fuels during a graduated load operation in a combustion chamber.

2. Background of the Invention

EP-B1-0 321 809 discloses a conical burner that consists of several shells stacked inside each other and that is used to create a closed rotational flow in the cone head. Because of the increasing rotation along the cone tip, this rotational flow becomes unstable and then changes to an annular rotational flow with a backflow bubble in the core. With this burner, gaseous fuels are preferably injected in the flow direction along air inlet channels and are mixed homogeneously with the air flowing in, before the combustion starts as a result of the ignition at the backup point of the backflow bubble. The air inlet channels are formed by the shells which extend, offset to each other, in the longitudinal direction of the burner. The backflow bubble performs the function of a bodiless flame holder. Liquid fuels are injected preferably via a central nozzle at the burner head, and they then evaporate in the conical cavity formed by the shells. During the operation of such a burner, which indisputably is characterized by minimal noxious emissions, it was found that for operation with a gaseous fuel, a longer premixing section would actually be advantageous, while for an operation with a liquid fuel the long premixing section results in compromises regarding the injection of the liquid fuel.

SUMMARY OF THE INVENTION

The present invention overcomes these and other deficiencies in the prior art by providing a burner of the aforementioned type which enables optimum mixing and burning with both gaseous and liquid fuels with a minimized construction length.

One essential advantage of the invention is that the length of the burner, which is constructed from a combination of conical or frustoconical flow channels, is minimized to the extent that the operation with a liquid fuel can be optimized while, according to the present invention, eliminating injection of this fuel at the burner head; at the same time, flow guidance of air is maintained in such a way that the operation with a gaseous fuel is not negatively affected by the shortened premixing section. The compactness of the burner according to the invention then makes it possible to optimize the burner air inflow from the plenum to the burners, for example in a power plant operated with an annular combustion chamber.

The design of the burner according to the present invention is geared towards a double premixing during operation with a gaseous fuel, whereby, if a liquid fuel is used, an injection of this fuel, which is preferably finely dispersed in one plane, is selected, and whereby this injection essentially takes place downstream from the premixing section for a gaseous fuel. At the burner outlet, a stable backflow bubble still forms, regardless of which fuel is used to operate the burner, i.e., the parts of this burner carrying the flow create the rotational flow that is necessary for the formation of the backflow bubble.

According to a preferred embodiment of the present invention, a burner for liquid fuels, gaseous fuels, or combinations thereof, for premixing combustion during a graduated load operation in a combustion chamber, includes an inner conical partial body that extends in the flow direction. An outer conical partial body is also provided, the cone of which extends opposite to the cone of said inner conical partial body. A pipe surrounds the outer conical partial body. The inner conical partial body and the outer conical partial body are connected to each other, so that when combustion air is supplied to the inner conical partial body and to the outer conical partial body, the combustion air flows through the inner conical partial body and through the outer conical partial body.

Still other objects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

A preferred embodiment of the invention is illustrated in the accompanying drawings, in which:

FIG. 2 is a cross-sectional view of the burner, as viewed at the section plane II—II in FIG. 3; and FIG. 3 is a cross-sectional view as viewed at the section plane III—III in FIG. 2.

DETAILED DESCRIPTION

Figure 1:
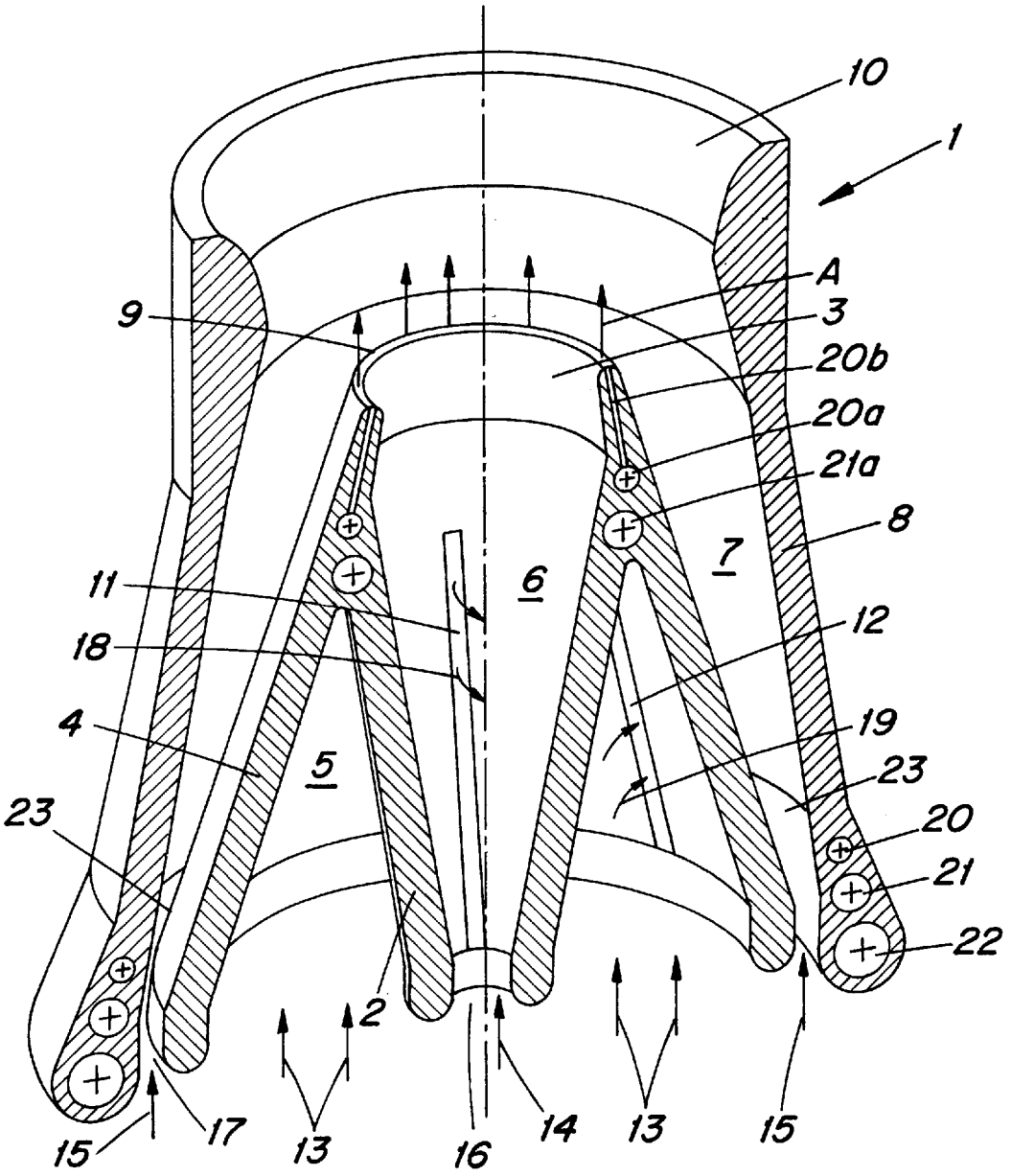
FIG. 1 is a perspective view, partially in cross-section, of a burner according to the present invention, formed by several conical channels.

The following describes a preferred embodiment of the invention in more detail with reference to the drawings. All elements not required for the direct understanding of the invention have been omitted. Identical elements have been identified with the same reference numbers in the various drawings. The flow direction of the different media is illustrated with arrows.

FIG. 1 illustrates a three-dimensional, perspective view of a burner 1, which includes a combination of several conical or frustoconical partial bodies that can accommodate the flow in several planes, whereby these partial bodies are operationally interdependent. An inner partial body 2 initially widens conically in the flow direction in relation to the flow-through cross-section, and then changes essentially to an inner cylindrical tapered shape 3 in its end phase. The inner conical partial body 2 is concentrically surrounded approximately in the area of this transition by another partial body 4, which, however, widens with respect to its flow-through cross-section in the counter-flow direction, i.e., in the direction opposite to the direction of flow, in such a way that the two partial bodies 2, 4 merge to form a central flow structure 2/4 so as to form a closed flow chamber 5, which is closed in the axial direction and which itself has the form of a hollow truncated cone with a decreasing cross-section in the flow direction. The stacked merger of the two partial bodies 2, 4 into a single central flow structure 2/4 results, when seen two-dimensionally, in an approximately M-shaped structure, as is illustrated in more detail in FIG. 2.

The previously mentioned inner cylindrical tapered shape 3 then forms the transition between the course of the inner partial body 2 on the inside and the beginning of the outer partial body 4. Another concentric pipe 8 surrounds the central flow structure 2/4, whereby the resulting annular flow-through cross-section 7 of this pipe 8 increases conically in relation to the circumferential surface of the central flow structure 2/4 in the flow direction. Downstream from the frontal face 9, which is part of the inner cylindrical tapered shape 3, the annular flow-through cross-section 7 of the concentric pipe 8 changes into a diffusor-like cross-section 10.

Both the inner conical partial body 2 and the outer conical partial body 4 are provided with a number of slits 11, 12 that extend tangentially in the flow direction and through which flows the main part of the available combustion air 13, flowing into the axially closed chamber 5 while forming a rotational flow on the one side in the inner chamber 6 of the inner conical partial body 2, then flowing into the annular flow-through cross-section 7 on the other side, as is illustrated by the arrows 18, 19 included in the drawing.

A smaller amount 14 of the overall available combustion air flows centrally through a head opening 16 of the inner conical partial body 2 into the inner chamber 6. Another, smaller amount 15 of the overall available combustion air flows axially through the annular opening 17 on the head into the annular flow-through cross-section 7. The fuel inflows and its admixtures are only suggested in FIG. 1. The operation of burner 1 is explained in more detail with reference to FIGS. 2 and 3.

FIG. 1 illustrates the individual fuel inflows that cover, in terms of direction, the bottom end of the concentric pipe 8. Three annular fuel lines 20, 21, 22, whose fuels are fed via connecting links 23 to the central flow structure 2/4, are provided. A liquid fuel A, e.g., oil, fed via line 20, flows through the outer partial body 4 and first ends in an annular line 20*a* arranged on the end of the former, from where this fuel A is then injected through a number of axially guided nozzles 20*b* that are distributed on frontal face 9 over the circumference thereof into the rotational flow effective there. A first premix gas (see FIG. 3, No. B) is added via the annular line 21 and ends in an annular line 21*a* at the end of the outer partial body 4 in order to be fed from here to the tangential slits 11 of the inner partial body 2. Then this fuel is mixed through fuel nozzles (see FIG. 3) into the air flow 18 that flows through the slits 11 at this point (see FIG. 3).

A second premix gas (see FIG. 3, No. C) is added to the outer partial body 4 via annular line 22 and is then injected directly through the tangential slits 19 of this partial body 4 into the air stream 19 flowing there (see FIG. 3). The configuration of partial bodies 2, 4 is not limited to a regular conical configuration, but can form a confusor or confusor-like configuration, as well as a diffusor or diffusor-like configuration. The term "conical," as used in the description of the present invention, is intended to include such a design.

FIG. 2 illustrates burner 1, as viewed at section plane II—II in FIG. 3. FIG. 2 illustrates rather well the fundamental structure of the central flow structure 2/4, which preferably substantially describes a M-shape. The rotational flow 24 that forms inside the annular flow-through cross-section 7 of the concentric pipe 8 is a combustion mixture of the combustion air 13 that is enriched with the combustion air 15 and mixed with the second premix gas C from the annular line 22. The other rotational flow 25 that forms inside the inner chamber 6 of the inner partial body 2 is a combustion mixture of the combustion air 13 that is enriched with the combustion air 14 and mixed with the first premix gas B from the annular line 21 or 21*a*. If the burner 1 is operated solely with the liquid fuel A, the rotational flow 24, 25 consists entirely of combustion air. The liquid fuel A is mixed in the area of the convergence of the two rotational flows 24, 25. The distance from the nozzles 20*a* to the burner outlet is relatively short, so that a large spraying angle of the nozzles 20*a* for the liquid fuel A can be selected. The shearing effect between the inner rotational flow 25 and the outer rotational flow 24 causes the liquid fuel A that is injected there to be optimally mixed. This makes it possible to form a mixture with a liquid fuel under premixing conditions here. The two rotational flows 24, 25 then combine in the area of the burner outlet, forming a main flow 26 which induces a backflow bubble 27. The latter acts in relation to the flame front forming there like a bodiless flame holder that stabilizes against flame flashbacks. A separate fuel supply of the two conical partial bodies 2, 4 enable a graduated increase during gas operation. This then makes it possible to minimize the construction length of the burner 1 without having to forego the quality and advantages of premixing combustion.

FIG. 3 illustrates a sectional through the plane III—III in FIG. 2. FIG. 3 illustrates the segmentation of the walls of both conical partial bodies 2, 4 by a number of tangentially arranged air inlet slits 11, 12, whereby the profiles of the individual segments is preferably a blade profile. FIG. 3 also illustrates the guidance of the individual fuel lines 21, 22, 23 through the individual, body-forming segments of the central flow structure 2/4. Providing several slits 11, 12 in an approximately circumferential direction, the axial length(s) of the slits can be kept smaller. The separate, individual supply of the inner air inlet slits 11 and the outer air inlet slits 12 with fuel enables a graduated bringing-up. The combustion air that flows into the inner chamber 6 creates a rotation in the opposite direction to the annular flow-through cross-section 7. Where this is required in terms of flow technology, it is easily possible to provide a rotation in the same direction through the inner and outer air inlet slits 11, 12. The segments that are part of the outer partial body 4 are provided on one side with nozzles 22*b* for fuel C, while the segments that are part of the inner partial body 2 include double injection ports 21*b* for the fuel B into the air inlet slits 11. As will be readily apparent to one of ordinary skill in the art, a corresponding adaptation of the number of injection openings may be realized on a case by case basis.

While the invention has been described in detail with reference to preferred embodiments thereof, it will be apparent to one skilled in the art that various changes can be made, and equivalents employed, without departing from the scope of the invention.

What is claimed is:

1. A burner for preparation of a premix combustion fuel-air mixture, said burner comprising:

an outermost, substantially rotationally symmetrical hollow body having an open upstream end and an open downstream end, said hollow body including a flow channel for combustion air to flow through said hollow body from said upstream end to said downstream end, said hollow body having a symmetry axis which defines a burner axis;

a substantially rotationally symmetrical central structure provided coaxially within said hollow body and dividing said hollow body flow channel into an annular outer section and an inner section, said central structure comprising an outer frustoconical hollow body with an open upstream end, an inner surface, and an outer surface, and an inner frustoconical hollow body with an open upstream end, an inner surface, and an outer surface, both said outer and inner frustoconical hollow bodies being coaxially arranged with said burner axis;

said outer frustoconical hollow body tapering downstream and defining a direction for combustion air flow in the axial direction in which said outer frustoconical body tapers;

said inner frustoconical hollow body tapering in a direction opposite from that of said outer frustoconical hollow body tapering;

said outer and inner frustoconical hollow bodies at least partly overlapping in a direction parallel with said burner axis so that either said inner frustoconical hollow body extends from said inner surface of said outer frustoconical body or said outer frustoconical body extends from said outer surface of said inner frustoconical hollow body, said outer and inner frustoconical hollow bodies dividing said inner section of said flow channel into a circular central flow passage; and chamber between said inner surface of said outer frustoconical hollow body and said outer surface of said inner frustoconical hollow body, said annular chamber tapering downstream.

2. The burner according to claim 1, wherein said inner and outer frustoconical hollow bodies each include a sidewall, and further comprising annular fuel feed lines formed in said inner and outer frustoconical hollow bodies' sidewalls and in said outermost hollow body.

3. The burner as claimed in claim 1, wherein said inner frustoconical hollow body comprises first tangentially arranged air inlet slits extending in a direction substantially parallel to said burner axis, and wherein said outer frustoconical hollow body comprises second tangentially arranged air inlet slits extending in a direction substantially parallel to said burner axis, said first air inlet slits connecting said chamber with said circular central flow section, and said second set of air inlet slits connecting said chamber with said annular outer flow section.

4. The burner according to claim 3, further comprising a plurality of second fuel nozzles positioned immediately adjacent to said first and second air inlet slits for introducing a fuel into the combustion air.

5. The burner according to claim 4, wherein said plurality of second fuel nozzles are configured for injecting a gaseous fuel.

6. The burner according to claim 5, wherein said plurality of second fuel nozzles are positioned to inject a first gaseous fuel through said first air inlet slits and for injecting a second gaseous fuel through said second air inlet slits.

7. The burner as claimed in claim 1, wherein said circular central flow passage has a frustoconical shape which widens downstream.

8. The burner as claimed in claim 1, wherein said central structure further comprises a downstream end and a plurality of first fuel nozzles, said first fuel nozzles being arranged circumferentially on said central structure downstream end.

9. The burner according to claim 8, wherein said first fuel nozzles are configured to be operated with a liquid fuel.

10. The burner as claimed in claim 8, wherein said first fuel nozzles are oriented in a direction substantially parallel with said burner axis.

* * * * *